US009669616B2

(12) United States Patent
Engelmann

(10) Patent No.: US 9,669,616 B2
(45) Date of Patent: Jun. 6, 2017

(54) DEVICE AND METHOD FOR PRINTING AND DRYING PLASTIC FILMS

(75) Inventor: Volker Engelmann, Bremervörde (DE)

(73) Assignee: RPC BEBO PRINT PATENT GmbH, Bremervorde (DE)

( * ) Notice: Subject to any disclaimer, the term of this patent is extended or adjusted under 35 U.S.C. 154(b) by 849 days.

(21) Appl. No.: 13/061,032

(22) PCT Filed: Aug. 10, 2009

(86) PCT No.: PCT/EP2009/005796

§ 371 (c)(1),
(2), (4) Date: Feb. 25, 2011

(87) PCT Pub. No.: WO2010/022857

PCT Pub. Date: Mar. 4, 2010

(65) Prior Publication Data

US 2011/0168041 A1 Jul. 14, 2011

(30) Foreign Application Priority Data

Aug. 27, 2008 (EP) ..... 08015149

(51) Int. Cl.
*B65H 23/00* (2006.01)
*B41F 23/04* (2006.01)
(Continued)

(52) U.S. Cl.
CPC ..... *B41F 23/043* (2013.01); *B41F 13/02* (2013.01); *B41F 23/0403* (2013.01); *B65H 23/1888* (2013.01); *B65H 2220/02* (2013.01); *B65H 2301/517* (2013.01); *B65H 2404/5521* (2013.01); *B65H 2513/11* (2013.01)

(58) Field of Classification Search
CPC .... B41F 13/02; B41F 23/043; B41F 23/0403; B41F 23/0436; B65H 23/1888; B65H 2301/517; B65H 2404/5521; B65H 2220/02; B65H 2513/11
USPC ..... 101/217, 492, 219, 228, 487; 242/615.11, 615.12
See application file for complete search history.

(56) References Cited

U.S. PATENT DOCUMENTS 2,204,801 A * 6/1940 Gessler ..... 34/463
2,268,987 A * 1/1942 Hess et al. ..... 101/424.1
(Continued)

FOREIGN PATENT DOCUMENTS

DE 31 14 406 A1 11/1982
EP 1 464 489 A2 10/2004
(Continued)

*Primary Examiner* — Jennifer Simmons
*Assistant Examiner* — Marissa Ferguson Samreth
(74) *Attorney, Agent, or Firm* — Finnegan, Henderson, Farabow, Garrett & Dunner, L.L.P.

(57) ABSTRACT

A device and method for printing and drying a plastic film web is provided, especially a device and method for printing and drying a polypropylene, polystyrene or polyethylene film web. The device can include several offset printing mechanisms for printing the film web with different ink applications and at least one flame drying station, characterized by a drawing roller, which is arranged between a last printing mechanism and the at least one flame drying station, and which can contact the unprinted surface of the film web, and apply tension to the film web.

13 Claims, 3 Drawing Sheets

(51) Int. Cl.
*B41F 13/02* (2006.01)
*B65H 23/188* (2006.01)

(56) References Cited

U.S. PATENT DOCUMENTS

| | | | | | |
|---|---|---|---|---|---|
| 2,414,891 | A | * | 1/1947 | Offen | 432/45 |
| 2,803,446 | A | * | 8/1957 | Flynn | 432/58 |
| 2,884,705 | A | * | 5/1959 | Flynn | 34/450 |
| 3,447,138 | A | * | 5/1969 | Carson et al. | 365/49.17 |
| 4,287,285 | A | * | 9/1981 | Mosehauer | 430/117.4 |
| 4,385,716 | A | * | 5/1983 | De Roeck et al. | 226/18 |
| 5,730,058 | A | * | 3/1998 | Borgardt | 101/483 |
| 6,076,466 | A | * | 6/2000 | Siler et al. | 101/488 |
| 2007/0012205 | A1 | * | 1/2007 | Chevalier et al. | 101/226 |
| 2007/0107256 | A1 | * | 5/2007 | Wiener et al. | 34/497 |
| 2009/0033733 | A1 | * | 2/2009 | Higashimoto et al. | 347/104 |

FOREIGN PATENT DOCUMENTS

| | | | | | |
|---|---|---|---|---|---|
| EP | 1 745 926 | A2 | | 1/2007 | |
| JP | 07101611 | | * | 4/1995 | B65H 23/32 |
| JP | 2007-170716 | | | 7/2007 | |
| WO | WO-2005/053958 | A1 | | 6/2005 | |

* cited by examiner

DEVICE AND METHOD FOR PRINTING AND DRYING PLASTIC FILMS

FIELD OF THE INVENTION

The present invention relates to a device and a method for printing and drying a plastic film web, in particular a polypropylene, polystyrene or polyethylene (PP, PS, or PE) film web.

BACKGROUND OF THE INVENTION

Such a device and such a method are already known from DE 44 30 527 C2. The device disclosed therein is characterised in that the film web is flame dried on its printed surface in the web feed direction after a last printing mechanism. Consequently, the offset printing mechanisms are directly connected to the flame drying station, with the result that the film web is guided with the tensile stress established during the printing process through the flame drying station, where even a low tensile stress can lead to deformation of the film web during the flame drying phase.

It is therefore an object of the present invention to provide such a method or such a device for the printing of film webs printed in the offset process, in which the printing mechanisms and the flame drying station are decoupled from one another in such a manner that different tensions of the film web can be established in the printing area and in the flame drying area with the result that the film web can be also be run in a tension-free manner in the flame drying region.

SUMMARY OF THE INVENTION

The object is achieved in a generically configured device according to the invention by providing a drawing roller between a last printing mechanism and the at least one flame drying station, which roller acts on the unprinted surface of the film web and applies tension to the film web. As a result, the printing area can be run with the desired web tension whilst the web tension can be reduced after the drawing roller so that a suitable lower tension can be established for the flame drying area. It is accordingly also possible for the web to be run free from tension in the flame drying area.

It is further preferred that the drawing roller is a driven (vacuum) roller provided with a plurality of openings formed on its lateral surface, which is suitable for applying negative pressure to the film web. By this means, the printing area can be suitably terminated, wherein the web tension of the film web can be adjusted by the intensity of the vacuum and the rotational speed of the drawing roller.

Preferably respectively one deflecting roller aligned at an angle of about 45° to the web feed direction is arranged between the last printing mechanism and the flame drying station and in the web feed direction after the flame drying station. The deflecting rollers have the task of reducing the space requirement of the device by deflecting the film web in a direction of 90° with respect to the web feed direction, then flame drying in this direction and finally deflecting back into the direction of the original web feed direction. As a result, the linear dimension of the system in the web feed direction can be reduced considerably since the comparatively large flame drying station can be arranged transversely to the web feed direction.

The deflecting rollers are preferably configured as stationary air cushion rollers which, as a result of the openings formed in the lateral surface, are suitable for applying an air cushion to the film web. With this arrangement, an air cushion is formed over the lateral surface of the rollers which provides a disturbance-free turning of the film web through 90°. Without a suitable air film, the rear side of the film web printed on the front side would be damaged.

It is preferred that the flame drying station has a plurality of flame drying devices, the nozzles whereof maintain a distance of 0.5 to 4 cm from the film web, a range of 1 to 3 mm being preferred and a range of 1.5 to 2.5 cm being particularly preferred. With these measures, satisfactory shock damping of the solvent contained in the liquid ink application is possible without deforming the film and with low energy consumption.

It is preferred that the flame drying devices or gas burners have an outlet nozzle for the flame, the free opening length whereof can be varied by closure devices arranged at the ends. As a result, the free outlet length of the nozzle can be varied continuously from about 600 mm to 820 mm. The closure devices are preferably partitioning devices which close the free opening.

The flame drying devices are preferably water-cooled which enhances their performance and reduces the heat loss.

An extraction station for gases formed during the flame drying process is preferably provided above the flame drying station. The extraction station purifies the waste air from vapours produced under shock evaporation of the solvent of the ink application and thereby creates an uncontaminated operating atmosphere.

A cooling tunnel inside which the web is cooled by an air flow is preferably arranged between flame drying station and rear deflecting roller and a cooling mechanism is arranged after the rear deflecting roller, said cooling mechanism comprising TEFLON-coated cooling rollers.

It is furthermore preferred that cooled rollers arranged in the region of the flame drying station below the film web are provided, which rollers serve as support rollers for the film web. A gentle looping of the rollers by the film web is provided in order to drive the roller through the running film web and ensure cooling of the film web by the water-cooled rollers. A gentle looping is achieved, for example, by clamping the rollers in the direction of the film web.

In the method according to the invention for printing and drying a plastic film web, in particular a PP, PS or PE film web, the film web is printed with different ink applications and then subjected to flame drying on the printed side, wherein tension is applied to the film web after printing and before flame drying on its unprinted side.

After printing and before flame drying as well as in the web feed direction after the flame drying, the film web is deflected by approximately 90° in each case. With this measure the flame drying process can be decoupled from the linear web feed direction and moved into a plane perpendicular to the linear web feed direction in order to reduce the dimensions of the installation.

During the deflection the film web is preferably guided by an air cushion. By this means, damage to the sensitive film can be avoided.

The width of the flame during the flame drying is preferably adjusted to the width of the film web.

The gases formed during the flame drying are preferably extracted in order to limit the contamination of the work area.

The film web is preferably cooled before the rear deflection and after the rear deflection. By this means sufficient cooling of the hot film web is ensured.

Further advantages, features and possible applications of the present invention are obtained from the following description of an exemplary embodiment in conjunction with the drawings.

DETAILED DESCRIPTION OF THE INVENTION

Figure 1:
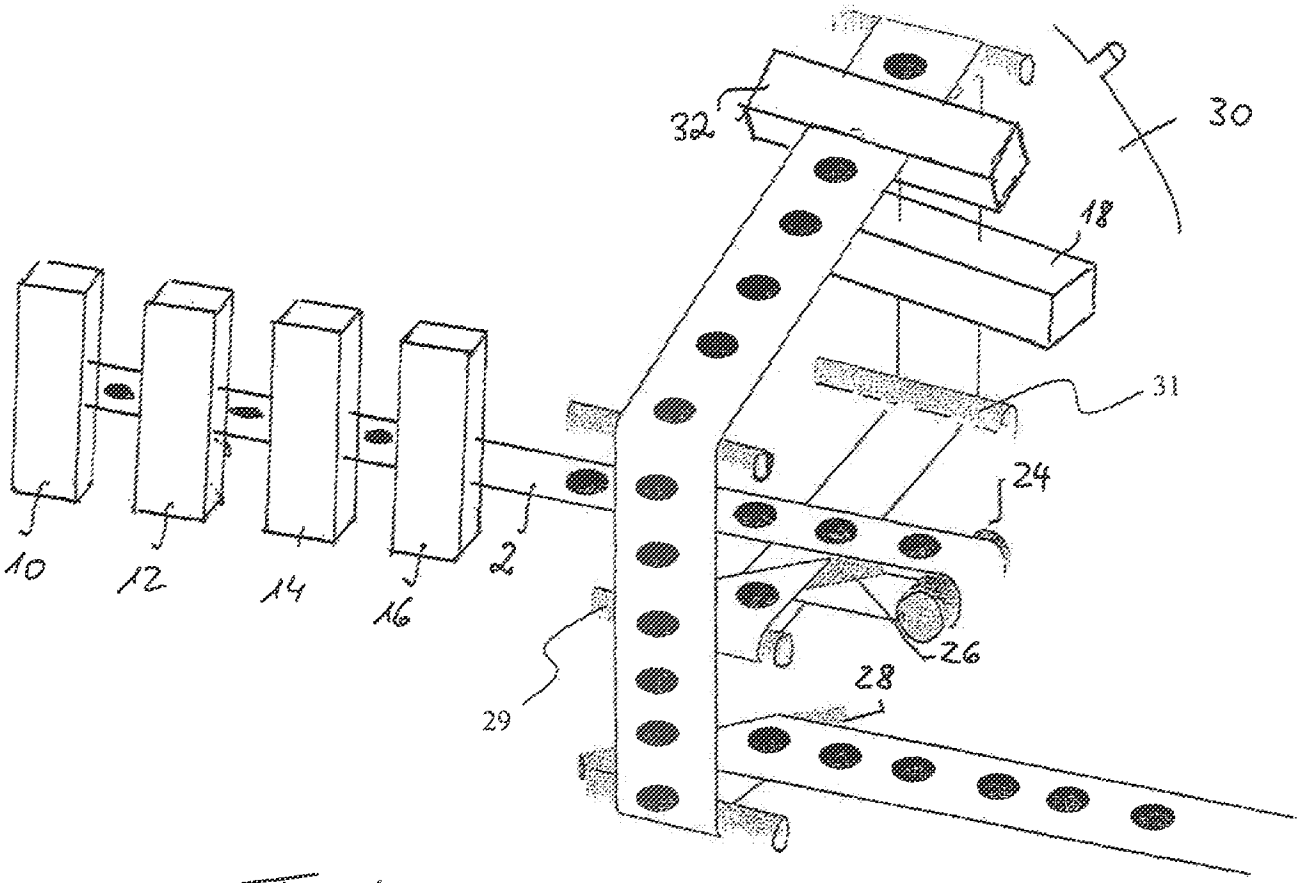
FIG. 1 shows a schematic view of an embodiment of the invention comprising a device for printing and drying plastic films.
Figure 2:
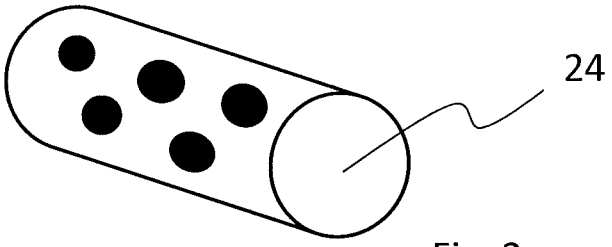
FIGS. 2-6 depict aspects of the embodiment of FIG. 1 consistent with the description and claims.

In FIG. 1 a plurality of printing mechanisms 10, 12, 14 and 16 arranged successively at a distance from one another in the web feed direction are provided, which mechanisms provide an approximately 300-600μ thick PP (polypropylene) film with applications of different ink. The printing mechanisms are suitable for withdrawing the film web from the roll and, with the aid of an infeed device, conveying and printing at a speed of 180 m/min. The PP film webs are printed in the roll offset process. The offset printing mechanisms are identified with the reference numbers 10, 12, 14, 16, the last printing mechanism being identified with reference number 16. Located after the last offset printing mechanism 16 in the web feed direction is a driven drawing roller 24 at negative pressure, which forms the termination of the printing area. The drawing roller 24 is provided with approximately 3 to 5 mm openings on its lateral surface (FIG. 2), through which the negative pressure formed in the interior of the vacuum roller is transferred to the film web so that this is pressed onto the drawing roller 24. The drawing roller 24 is a so-called unilaterally acting drawing roller, where the drawing speed and the web tension can be adjusted depending on the infeed set in the printing mechanisms by adjusting the rotational speed of the roller and the intensity of the vacuum. The drawing roller 24 designated as vacuum roller is provided with its own motor for producing negative pressure and has a stationary extraction region inside the driven roller which extends over at least 180° of the cylinder segment. This ensures that a sufficient area of the extracted film web is forcibly conveyed by the vacuum roller. The vacuum roller forms the termination of the printing area and separates the printing area from the flame drying area. In the prior art these areas were not separated so that at high web tension the film was overstretched in the flame drying area and possibly destroyed.

Provided after the vacuum roller or drawing roller 24 in the web feed direction is a non-driven, stationary microporous deflecting roller 26, which is disposed at an angle of 45° to the web and which is provided with a plurality of openings on its lateral surface, through which an air flow conveyed in the interior is applied to the lateral surface so that it can form an air cushion or an air film there. The openings have a size in the range of 1-3 My. The air film or the air cushion provides for disturbance-free turning of the film web through 90° on its unprinted surface. Without an air film or an air cushion, there would be the risk of the rear side of the film web being damaged. A stationary arrangement of the deflecting roller 26 is preferred since as a result of a possible rotation of the roller, the web guidance could be influenced, which is important to avoid. It is provided that a pressure of 6 to 10 bar is applied to each roller. As a result of the air film formed on the surface, the film does not rest on the lateral surface but as a result of the air cushion formed, is at a distance of several micron from the lateral surface of the deflecting roller.

Figure 3:
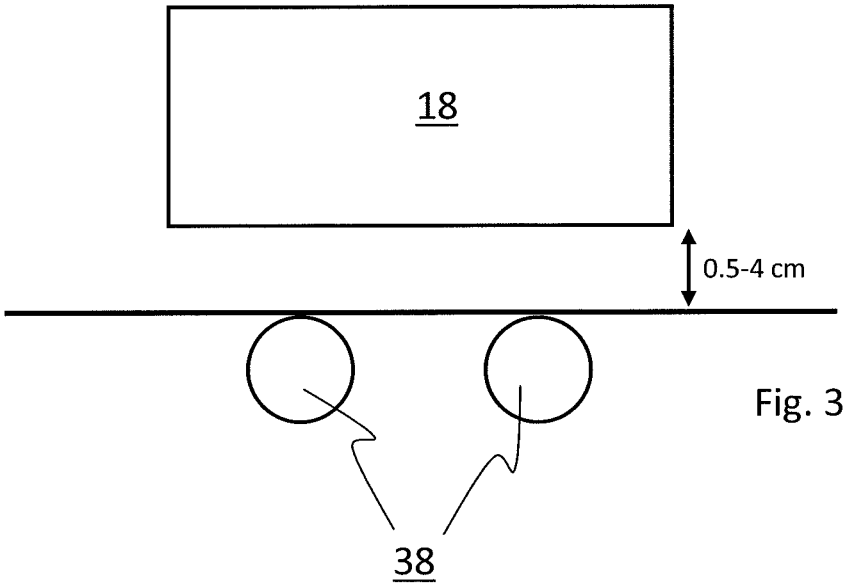

The film web deflected by 90° with respect to the original web feed direction is initially passed over a roller 29 and then guided over a roller 31 into a drying station 18 which is formed from a group of three successively arranged flame drying devices or gas nozzles, each having three rows. Each flame drying device extends over a length of 780 to 820 mm but as a result of the closure devices (not shown) attached at the ends, can be shortened to a free opening length of 600 mm. The flame drying devices are water-cooled, a heating power of 150 kW being provided for one three-row burner. The nozzles of the flame drying devices maintain a distance of preferably 1 to 3 cm, particularly preferably 1.5 to 2.5 cm from the surface of the film web. (FIG. 3.) Cooled rollers 38 in the form of support rollers looping the film web are provided underneath the flame drying devices to prevent any deformation of the film web. The cooled rollers 38 provide a gentle looping of the film web so that the rollers can be driven by the film with the result that the water-cooled rollers also cool the film.

Located after the flame drying station 18 is a cooling tunnel 32 which extracts an air flow and guides it past cooling fins onto the film web 2 so that the web is cooled with an approximately 15° C. cold air flow.

Gas extraction station 30 is depicted above flame drying station 18.

Figure 4:
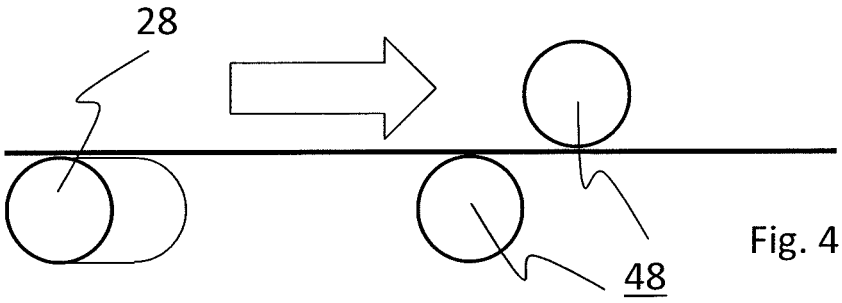
Figure 5:
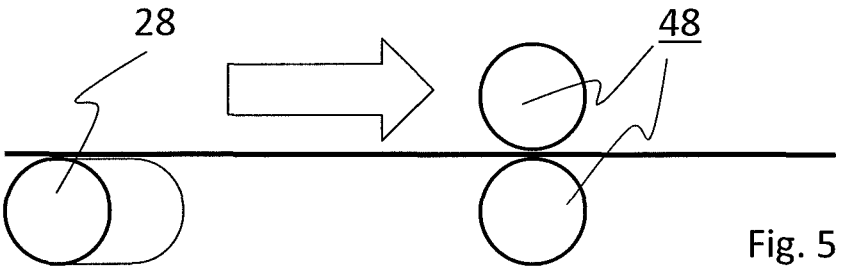
Figure 6:
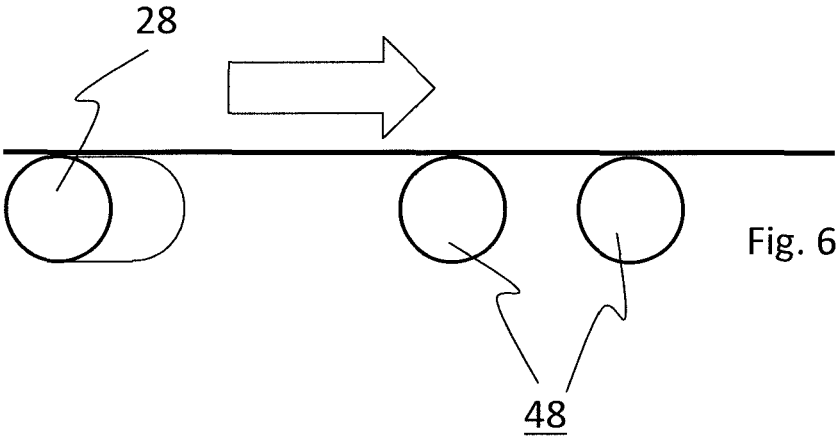

Located in the web feed direction after the rear microporous deflecting roller 28 is a first cooling mechanism comprising cooling rollers 48 cooled to about 20° C. which are temperature rollers are suitable for cooling the film web of about 70° C. to about 40° C. (FIGS. 4-6.) The cooling rollers 48 are preferably coated with TEFLON tape to avoid attachment of the film web or adhesion.

Located in the web feed direction after the rear microporous deflecting roller 28 is a first (not shown) cooling mechanism comprising cooling rollers cooled to about 20° C. which are suitable for cooling the film web from a temperature of about 70° C. to about 40° C. The cooling rollers are preferably coated with Teflon tape to avoid attachment of the film web or adhesion.

Located after the first cooling mechanism is a painting mechanism (not shown) which applies a dispersion paint exclusively to the printed side of the film web.

Located after the painting mechanism in the web feed direction is a hot air drying device with approximately 80° C. hot air, which is suitable for taking up any solvent residues still present and drying the printing side of the film web.

Located after the hot air drying station in the web feed direction is a second cooling mechanism which also comprises 20° C. cooled cooling rollers which are suitable for lowering the film temperature to a temperature of 25 to 28° C.

Located after the second cooling mechanism is a rolling mechanism by which means the printed and sufficiently dried film web is wound, the speed of the winding roller and the web tension being reduced as the radius of the winding increases so that a continuous winding process at constant conveying speed can be ensured. The device according to the invention and the method according to the invention thus enable a decoupling of the printing area from the flame drying area by the unilaterally acting drawing roller, which appreciably reduces the risk of damage to the film in the non-decoupled flame drying phase according to the prior art. Furthermore, due to the deflecting rollers disposed before and after the flame drying station, a considerable space saving can be achieved by displacing the drying process perpendicular to the original print feed direction. The loss of quality hitherto accepted in the prior art is eliminated and the waste reduced. The risk of doubling (inaccurate matching of points between successive ink mechanisms) is also reduced.

An alternative to the unilaterally acting drawing roller or vacuum roller would be bilateral rollers where the upper roller merely acts in the area of the printed side of the film free from the printing design. Such an arrangement is preferred under specific conditions.

What is claimed is:

1. A device for printing and drying a polypropylene, polystyrene or polyethylene film web, the device comprising a plurality of offset printing mechanisms for printing the film web with different ink applications, at least one flame drying station for flame drying a printed side of the film web, and a drawing roller arranged between a last printing mechanism and the at least one flame drying station, wherein the drawing roller acts on an unprinted surface of the film web and applies tension to the film web, so that a web tension in a flame drying area is reduced compared with a web tension in a printing area, wherein a cooling tunnel is arranged between the at least one flame drying station and a rear deflecting roller, wherein a cooling mechanism is arranged after the rear deflecting roller, and wherein the cooling mechanism comprises polytetrafluoroethylene-coated cooling rollers.

2. The device according to claim 1, wherein the drawing roller is a driven vacuum roller provided with a plurality of openings formed on its lateral surface, and wherein the vacuum roller is configured to apply negative pressure to the film web through its openings.

3. The device according to claim 1, comprising a deflecting roller aligned at about 45° to a web feed direction, and a rear deflecting roller aligned at about 45° to the web feed direction, wherein the deflecting roller is arranged between the last printing mechanism and the at least one flame drying station, and wherein the rear deflecting roller is arranged in the web feed direction after the at least one flame drying station.

4. The device according to claim 3, wherein the deflecting roller and the rear deflecting roller are configured as stationary air cushion rollers which, as a result of openings formed in a lateral surface, are suitable for applying an air cushion to the film web.

5. The device according to claim 1, wherein a portion of the at least one flame drying station is configured to maintain a distance of 0.5 to 4 cm from the film web.

6. The device according to claim 5, wherein an extraction station for gases formed during flame drying is provided above the at least one flame drying station.

7. The device according to claim 1, 2, 3, 4, 5, or 6, wherein cooled rollers arranged in a region of the at least one flame drying station below the film web are provided, which cooled rollers serve as support rollers for the film web.

8. A method for printing and drying a polypropylene, polystyrene or polyethylene film web, the method comprising:

printing the film web with different ink applications;

subjecting the film web to flame drying on a printed side using at least one flame drying station; and applying tension to the film web on an unprinted side thereof after printing and before flame drying, so that a web tension in a flame drying area is reduced compared with a web tension in a printing area, wherein a cooling tunnel is arranged between the at least one flame drying station and a rear deflecting roller, wherein a cooling mechanism is arranged after the rear deflecting roller, and wherein the cooling mechanism comprises polytetrafluoroethylene-coated cooling rollers.

9. The method according to claim 8, comprising:

deflecting the film web by approximately 90° after printing and before flame drying; and deflecting the film web by approximately 90° in a web feed direction after the flame drying.

10. The method according to claim 9, wherein the film web is guided by an air cushion while being deflected.

11. The method according to claim 8, wherein a width of a flame during the flame drying is adjustable.

12. The method according to claim 8, wherein gases formed during the flame drying are extracted.

13. The method according to claim 8, wherein the film web is cooled between flame drying and rear deflection and after the rear deflection.

* * * * *